US005241144A

United States Patent [19]

Meagher et al.

[11] Patent Number: 5,241,144

[45] Date of Patent: Aug. 31, 1993

[54] SELF-ADJUSTING MULTICIRCUIT BRAKE SWITCH

[75] Inventors: James P. Meagher; Benjamin F. Chestnut, both of Indianapolis, Ind.

[73] Assignee: Emerson Electric Co., St. Louis, Mo.

[21] Appl. No.: 903,155

[22] Filed: Jun. 24, 1992

[51] Int. Cl.[5] ..... H01H 3/14

[52] U.S. Cl. ..... 200/61.89

[58] Field of Search ..... 200/61.89, 38 B, 6 R, 200/6 B, 6 BA, 6 BB

[56] References Cited

U.S. PATENT DOCUMENTS

| | | | |
|---|---|---|---|
| 3,651,297 | 3/1972 | Jones | 335/151 |
| 3,727,015 | 4/1973 | Voland et al. | 200/38 R |
| 3,886,953 | 6/1975 | Pope | 131/170 A |
| 4,719,444 | 1/1988 | Leigh-Monstevens et al. | 200/61.89 X |
| 4,742,193 | 5/1988 | Kassin et al. | 200/61.89 |
| 4,878,041 | 10/1989 | Leigh-Monstevens et al. | 200/61.89 X |
| 4,911,276 | 3/1990 | Leigh-Monstevens et al. | 200/61.89 X |
| 5,162,625 | 11/1992 | Comerford | 200/61.89 |

*Primary Examiner*—J. R. Scott

*Attorney, Agent, or Firm*—Robert F. Meyer; Eric R. Waldkoetter

[57] ABSTRACT

A self-adjusting multicircuit brake switch is accomplished by employing a switch housing with an integral mounting means that is carried on a brake pedal actuation pin. The brake master cylinder push rod is also carried on the brake pedal actuation pin and directly actuates a plunger on the brake switch eliminating the need for adjustment. Multicircuit capability is provided by a plurality of blade switches that are actuated by the plunger with integral activation arms. The plunger's integral activation arms can be configured to: make or break electrical contacts when the plunger is depressed, mechanically break electrical contacts, sequence blade switch operation, and be micro-adjusted during production to compensate for component tolerance variations. Additionally, blade switches can be configured to provide contact wiping action.

20 Claims, 10 Drawing Sheets

SELF-ADJUSTING MULTICIRCUIT BRAKE SWITCH

BACKGROUND OF THE INVENTION

This invention relates to a self-adjusting automotive brake pedal actuated switch assembly. Automotive brake pedal actuated switch assemblies are widely used to control a variety of automotive functions when a brake pedal is depressed such as: energizing brake lights, deactivating a cruise control, signaling an anti-lock brake system, signaling a torque converter clutch, and signaling a transmission shift interlock.

In prior art automotive brake pedal mounted and actuated self-adjusting switch assemblies only one switching circuit is available, switch terminals are riveted to the internal switch springs, spring beam force is relied upon to break contacts, and the switch design lacks flexibility.

The limitation of having only one switching circuit in an automotive brake switch will generally require the use of multiple switches because modern vehicles typically require multiple circuits for such functions as: deactivating a cruise control, signaling an anti-lock brake system, signaling a torque converter clutch, and signaling a transmission shift interlock in addition to the usual function of energizing brake lights.

The prior art practice of riveting or welding electrical terminals to internal switch springs doubles the number of electrical connections compared to having electrical terminals that are integral to internal switch springs. Since an objective of switch design is to have as few electrical connections as possible, the additional electrical connections in prior art designs decrease reliability.

The practice of relying upon spring beam pressure to break electrical contacts can present problems when switching higher loads such as brake lamps. Contacts on higher current circuits can weld together due to metal transfer that causes pitting and crowning. The prior art practice of relying on spring beam pressure to break a contact weld may not be successful and cause switch failure.

The basic design of earlier self-adjusting automotive brake switches prevents the switch designer from making minor preplanned modifications to provide a customer with the choice of a variety of features such as additional switching circuits, contacts that open or close when the brake pedal is depressed, mechanical (rather than spring beam pressure) contact breaking, switch sequencing, wiping or non-wiping contact. If prior art switches can provide these type of features, it usually requires either the use of multiple switches or major design and production changes.

SUMMARY OF THE INVENTION

Accordingly a brake pedal actuated switch assembly is provided that does not require adjustment; has multiple circuits; and, provides the switching options of contacts that open or close when the brake pedal is depressed, mechanical (rather than spring beam pressure) contact breaking, switch sequencing, and wiping or non-wiping contact. In general the self-adjusting multicircuit automotive brake pedal actuated switch assembly comprises: a housing, a mounting means integral to the housing for mounting said housing on a pedal, a plurality of switches enclosed in the housing, and a spring biased plunger with integral switch activation arms selectively engaging the plurality of switches actuated prior to movement of a master cylinder push rod connected to the pedal.

DETAILED DESCRIPTION OF THE DRAWINGS

Figure 1:
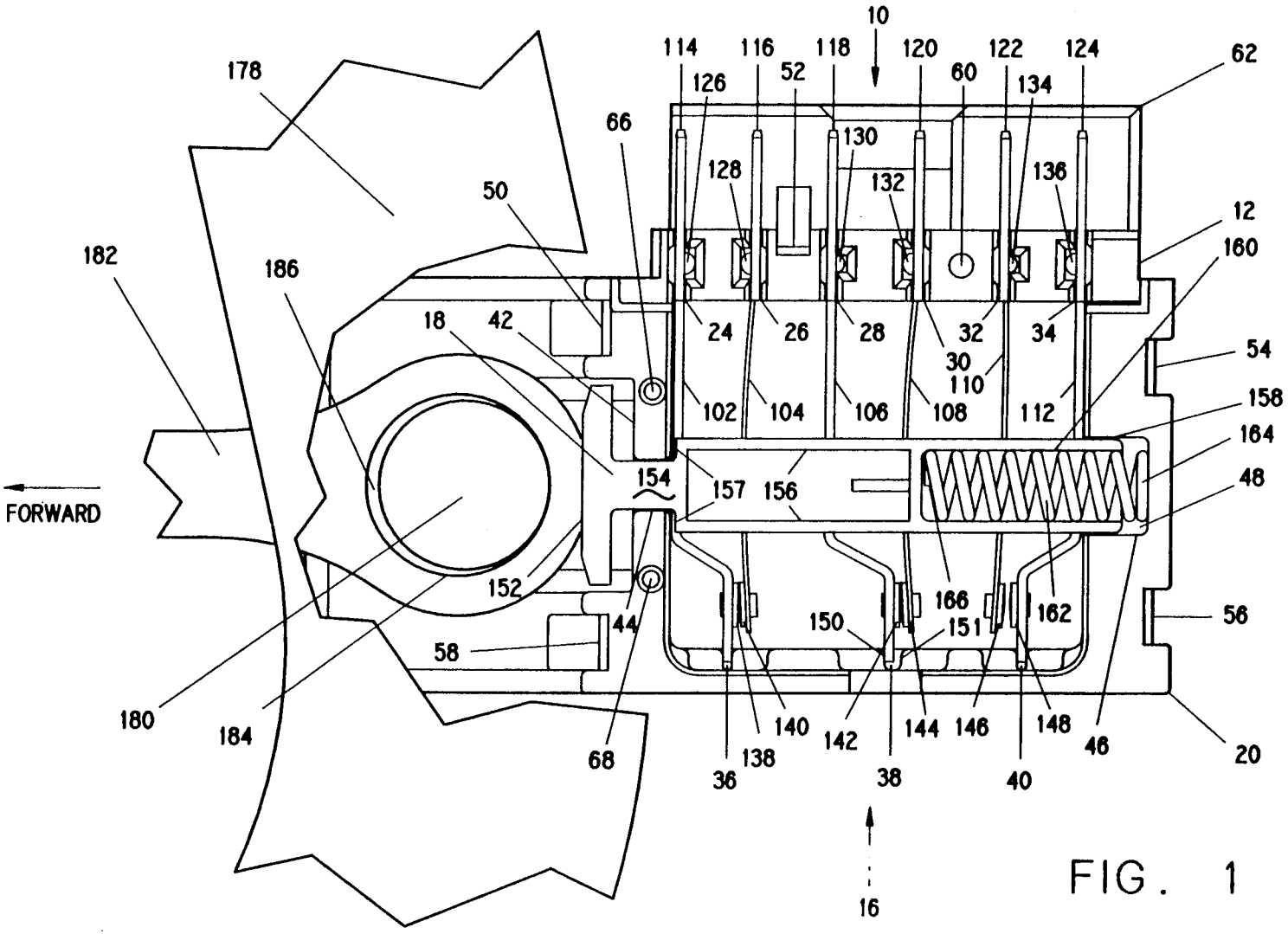
FIG. 1 is a view of the invention in a spring biased position.

Referring to FIG. 1 there is shown an installed self-adjusting multi-circuit brake switch 10. The self-adjusting multi-circuit brake switch 10 includes a housing 12, a mounting means 14, a plurality of switches 16, and a plunger 18.

Figure 6:
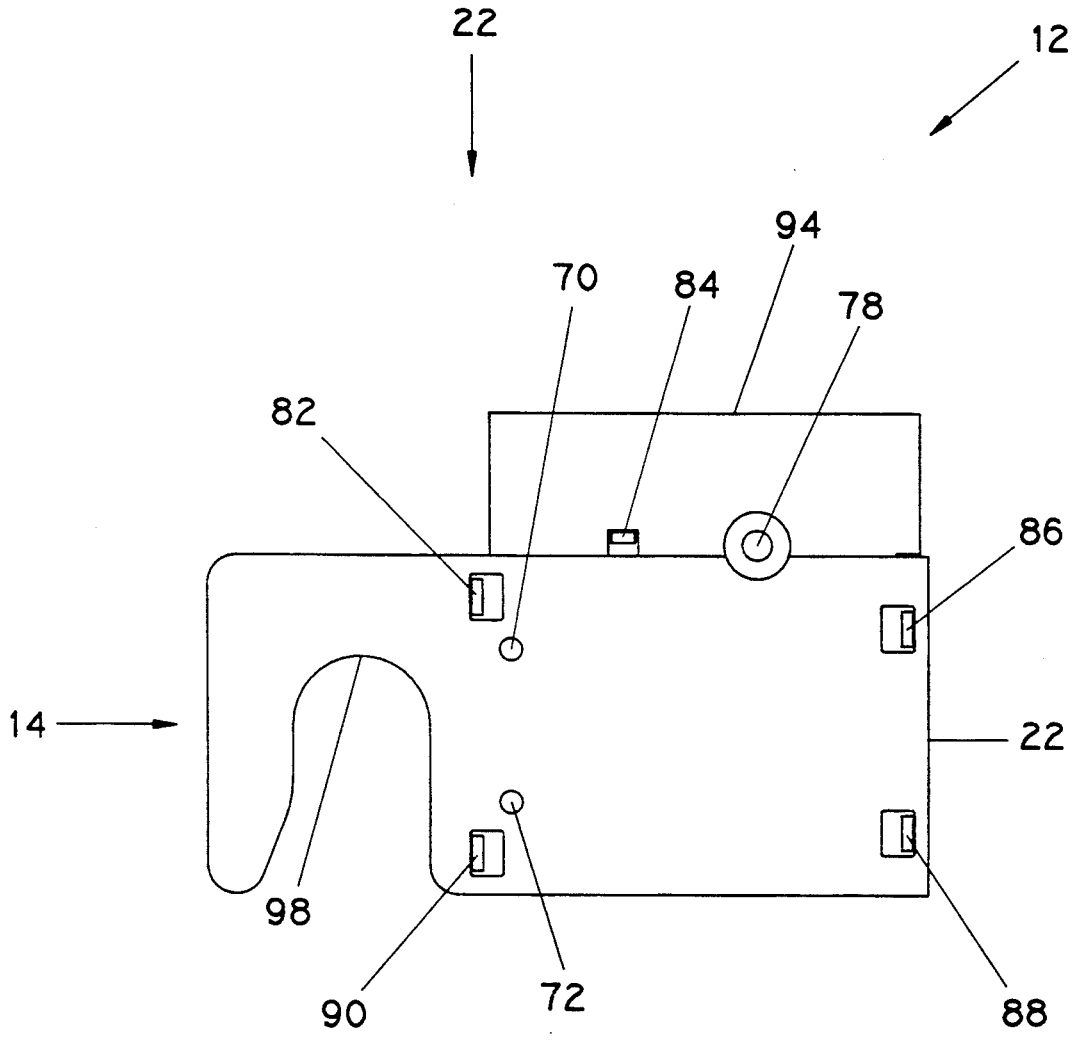
FIG. 6 is an exterior view of a housing cover.

The housing 12 is molded from a CELEANESE N-276 material and includes a housing base 20, and a housing cover 22 (FIG. 6). The housing base 20 has terminal slots 24, 26, 28, 30, 32, 34 that serve to fix the plurality of switches 16 in the housing base 20. Stationary blade mounts 36 and 40 and stationary blade wiping mount 38 in the housing base 20 also provide a means to fix the plurality of switches 16 in the housing base 20. A plunger head recess 42, housing plunger head journal 44, a housing plunger rear journal 46, and a housing plunger spring recess 48 cooperate to provide axial displacement of the plunger 18 in the housing base 20.

Figure 7:
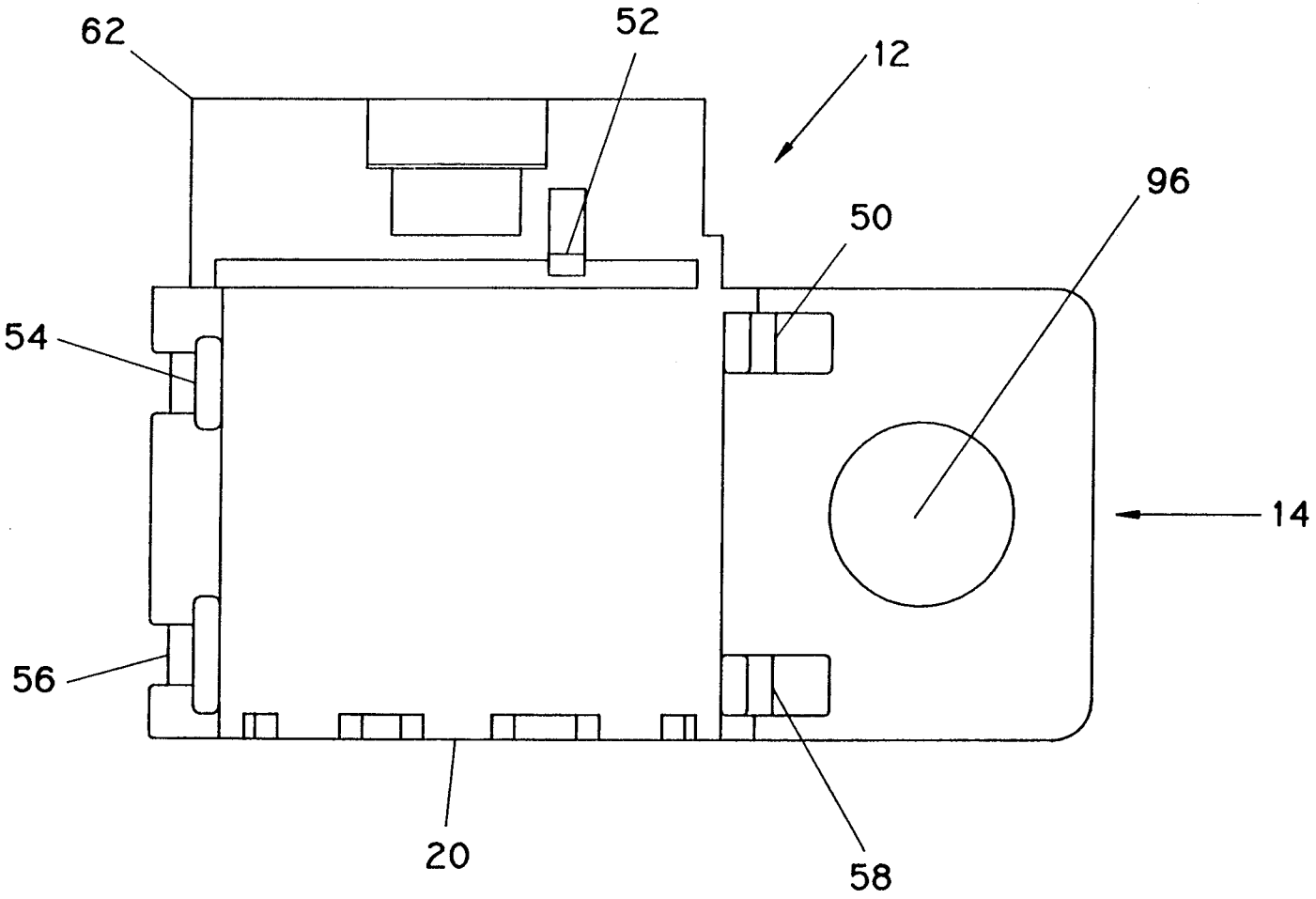
FIG. 7 is an exterior view of a housing base.
Figure 9:
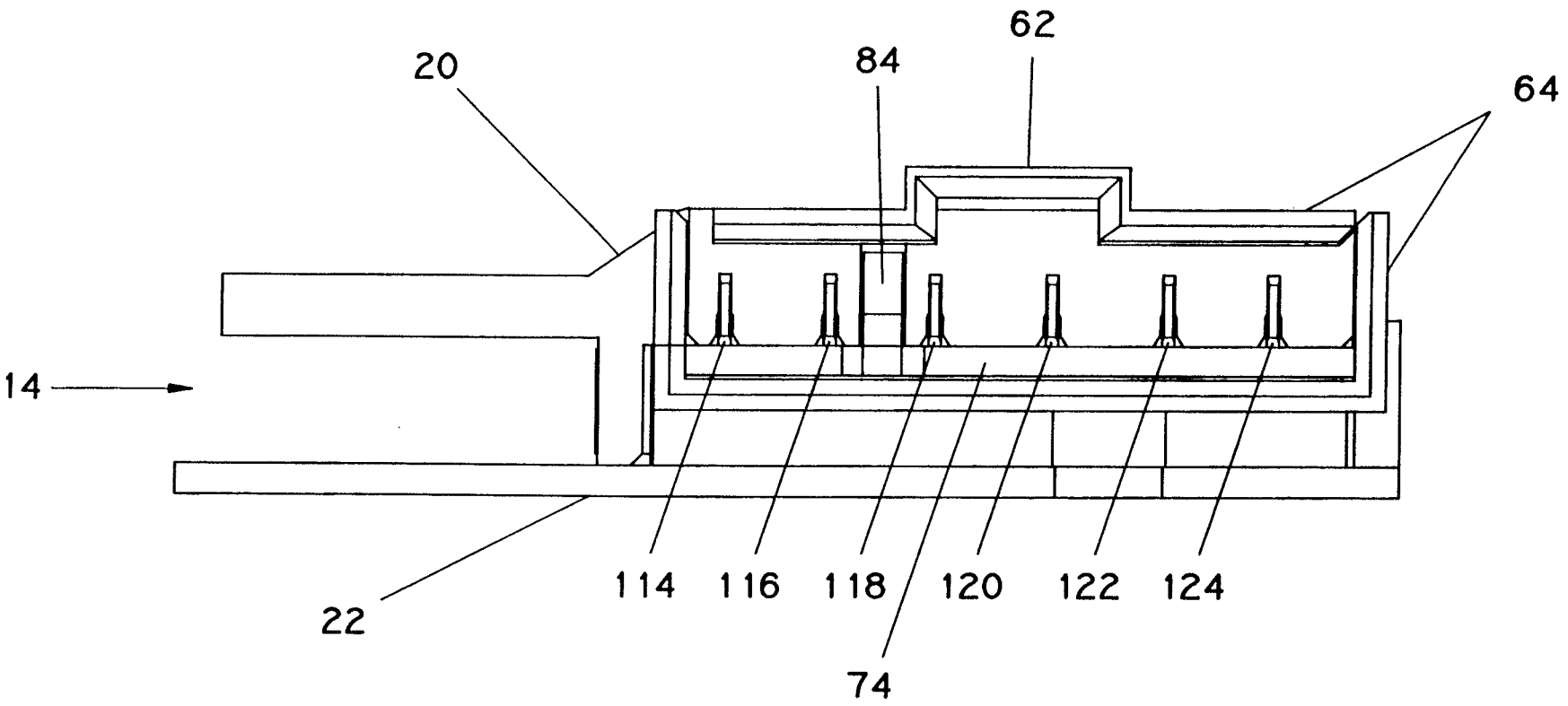
FIG. 9 is a side-view of the assembled invention.

The housing base 20 has five female barb connectors 50, 52, 54, 56, and 58 for use in aligning and attaching the housing cover 22 (FIG. 7). The housing base 20 has a screw hole 60 (FIG. 1) to provide an additional means for attaching the housing cover 22 (FIG. 6) to the housing base 20 to better secure the plurality of switches 16. The housing base 20 also has a female terminal socket base 62 which forms a portion of the female terminal socket 64 (FIG. 9). The female terminal socket 64 is a PACKARD ELECTRIC METRI-PACK 480 series standard automotive female connector.

Figure 8:
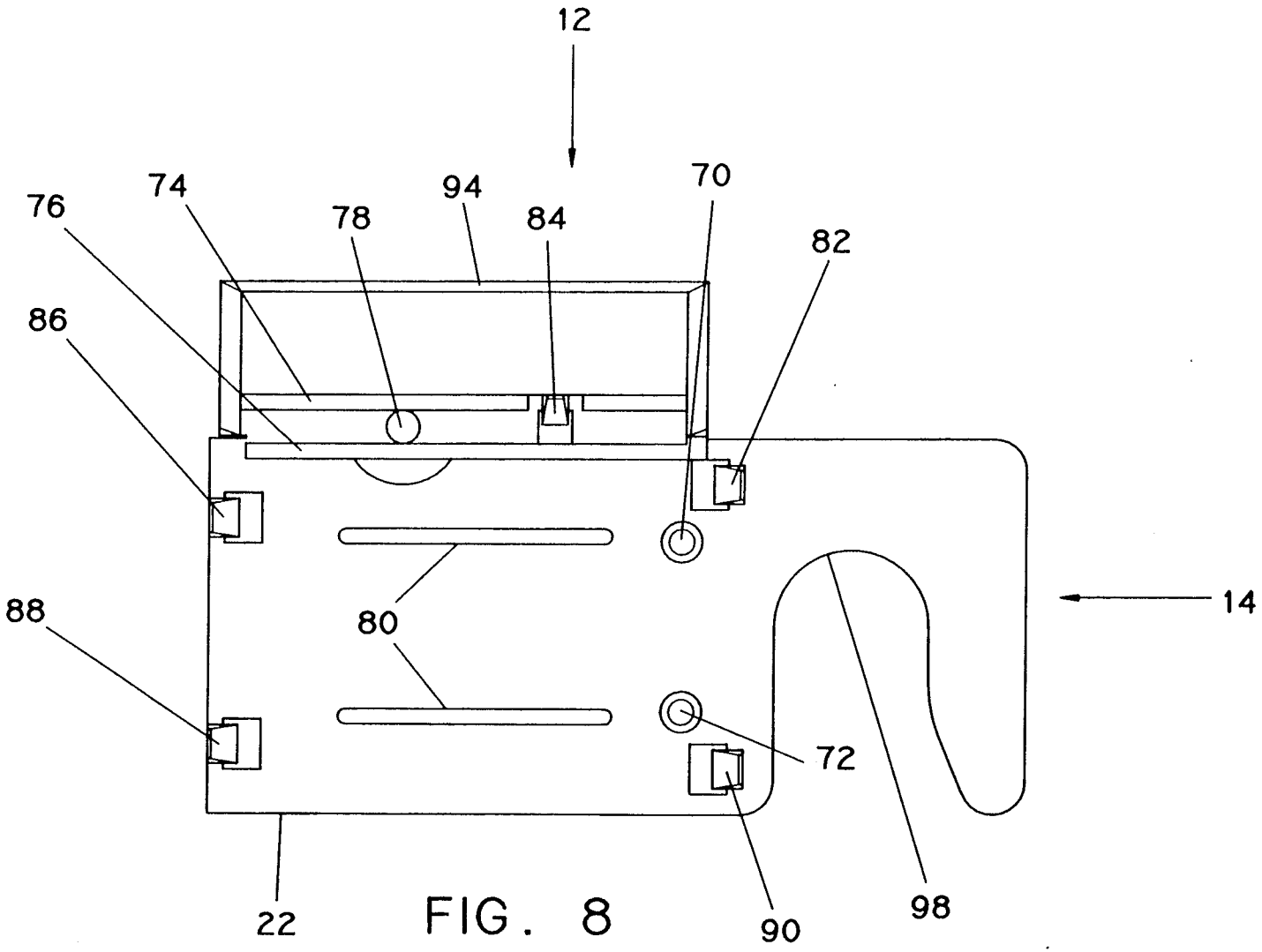
FIG. 8 is an interior view of the housing cover.

Referring to FIGS. 1 and 8, the housing cover 22 is aligned on the housing base 20 for assembly by housing base 20 pins 66 and 68 that fit in housing cover 22 pin holes 70 and 72 respectively. The housing cover 22 also has terminal retention bars 74 and 76, attachment screw hole 78, and anti-warp bars 80. The housing cover 22 is further aligned and attached to the housing base 20 by five male barbed connectors 82, 84, 86, 88, and 90 that engage housing base's 20 five female barbed connectors 50, 52, 54, 56, and 58 respectively. The exterior of the housing cover 22 (FIG. 6) is smooth to prevent interference with other automobile components. The housing cover 22 has a cover screw hole 78 that aligns with housing base 20 screw hole 60 to provide an additional means for attaching the housing cover 22 to the housing base 20 to better secure the plurality of switches 16. The housing cover 22 also has a female terminal socket cover 94 that along with female terminal socket base 62 forms female terminal socket 64 (FIG. 9).

Figure 5:
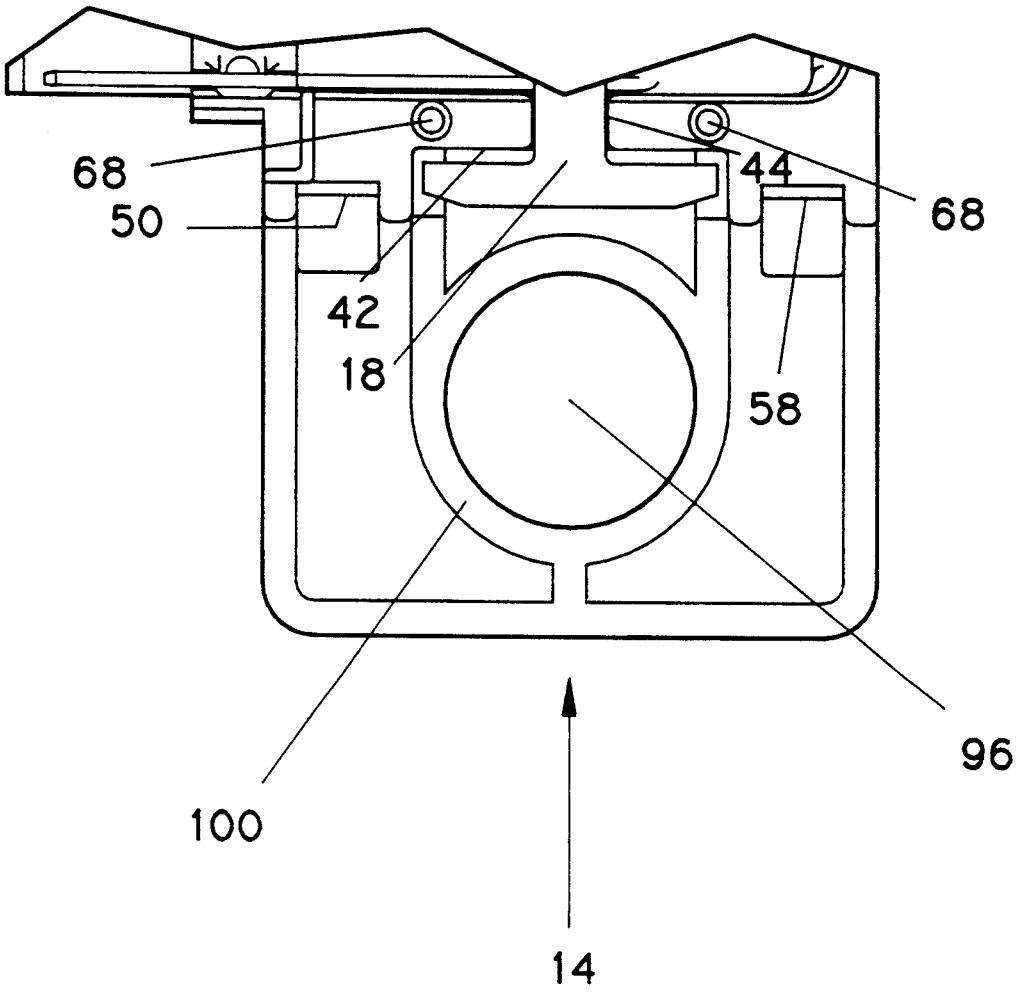
FIG. 5 is view of a housing base mounting means bushing.

Referring to FIGS. 5, 6 and 7, the mounting means 14 includes pedal pin hole 96, and pedal pin slot 98 for attaching the self-adjusting multicircuit automotive brake switch 10 to an automobile brake pedal 178 (FIG. 1). The mounting means 14 includes bushing 100 integral to the housing base 20 to serve as a bearing for movement of the self-adjusting multicircuit brake switch 10 when a brake pedal 178 (FIG. 1) is depressed.

Referring to FIG. 1, the plurality of switches 16 includes stationary blades 102, 106, 112; spring blades 104, 108, 110; integral terminals 114, 116, 118, 120, 122, 124; alignment nubs 126, 128, 130, 132, 134, 136; stationary blade electrical contacts 138, 142, 148; and, spring blade electrical contacts 140, 144, 146. Stationary blades 102, 106, and 112 are manufactured from a copper alloy with good stiffness properties. Spring blades 104, 108, and 110 are manufactured from a copper alloy with good spring properties to be biased closing the plurality of switches 16.

Integral terminals 114, 116, 118, 120, 122, and 124 fit in terminal slots 24, 26, 28, 30, 32, and 34 respectively. Spring blade integral terminals 116, 120, and 122 are made by folding over the copper alloy material to create spring blade integral terminals 116, 120, and 122 that are twice as thick as spring blades 104, 108, and 110. Spring blade integral terminals 116, 120, and 122 are more rigid due to their double thickness and approximately the same thickness as stationary blades 102, 106, and 112. The double thickness and increased rigidity of spring blade integral terminals 116, 120 and 122 improve their ability to mate with a female connector. Alignment nubs 126, 128, 130, 132, 134, and 136 that are integral to terminals 114, 116, 118, 120, 122, and 124 respectively align the terminals and prevent them from moving axially.

Electrical contacts 140 and 144 are silver plated copper rivets that are riveted to spring blades 104 and 108 respectively. Electrical contacts 138, 142, and 148 are also silver plated copper rivets that are riveted to stationary blades 102, 106, and 112 respectively.

Electrical contact 146 is a silver-copper-nickel alloy contact that is riveted to spring blade 110 to provide decreased pitting for high current applications such as brake lamps. Current flow is from contact 146 to contact 148, so the normal transfer of metal that occurs in high current applications will transfer some of the noble metal of contact 146, a silver-copper-nickel alloy, to the less noble metal of contact 148, a silver plated copper.

Stationary blade mounts 36 and 40 along with stationary blade terminal mounts 24 and 34, fix stationary blades 102 and 112 in the housing base 20. Stationary blade wiping mount 38 is sized wider than stationary blade mounts 36 and 40 and also wider than the thickness of stationary blade 106, to permit movement of stationary blade 106 when pressure is applied or released. Stationary blade 106 is biased toward stationary blade wiping mount rearward edge 151, but when the plunger 18 is in the spring biased position (FIGS. 1 and 2) the plunger 18 applies pressure to spring blade 108 which in turn applies pressure to stationary blade 106 forcing it against stationary blade wiping mount forward edge 150.

It is a feature of this invention that any or all stationary blades 102, 106, and 112 can be configured to provide a wiping action when the plunger 18 is depressed causing spring blades 104, 108, and 110 to make or break contact with stationary blades 102, 106, and 112.

Figure 10:
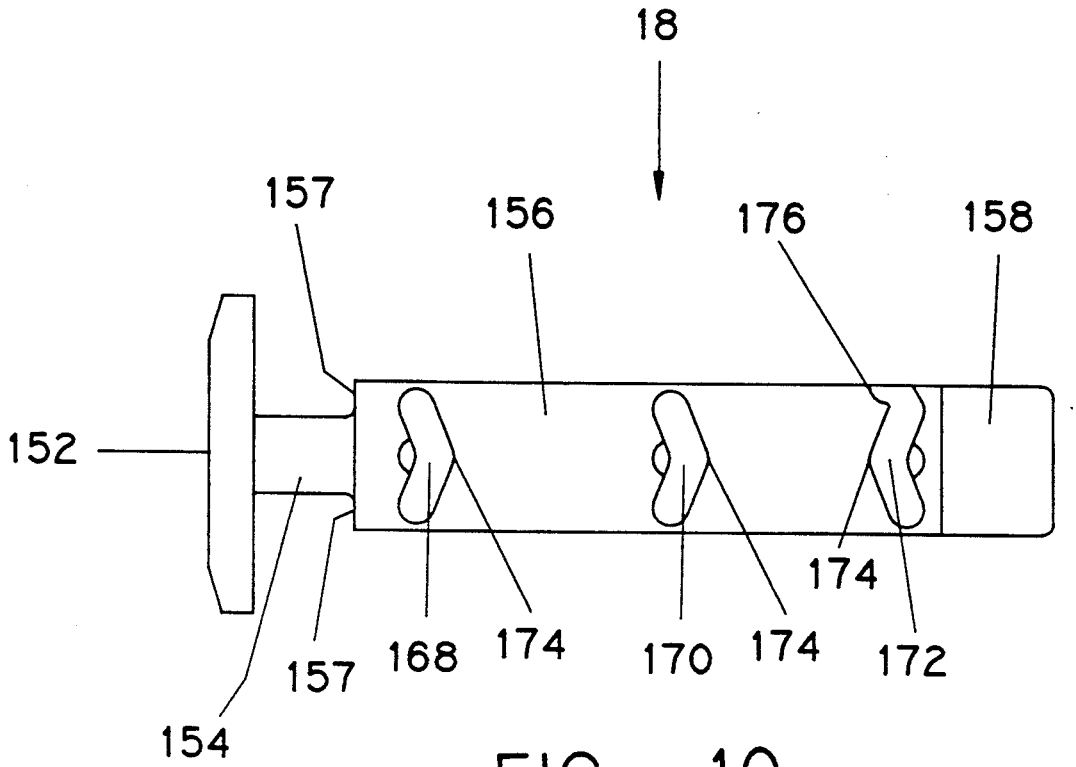
FIG. 10 is a view of a plunger.
Figure 11:
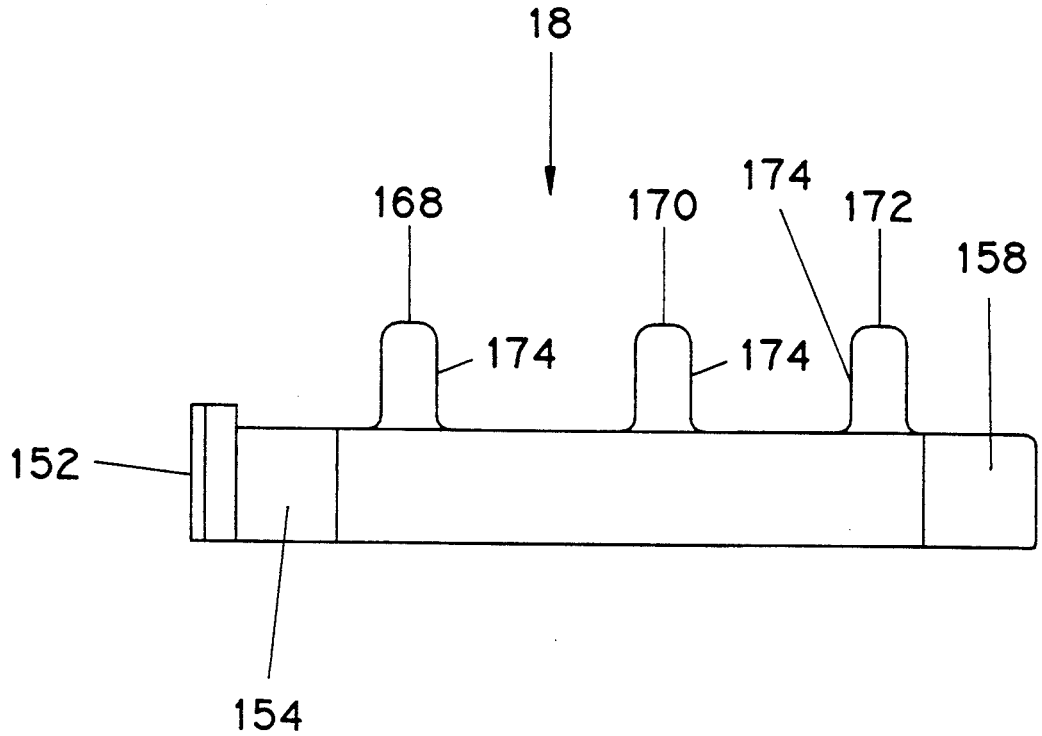
FIG. 11 is another view of the plunger.

The spring biased plunger 18 includes a plunger head 152, a plunger head bearing 154, a plunger body 156, a plunger extension stop 157, a plunger rear bearing 158, a plunger spring housing 160; a plunger spring 162 including a stationary spring end 164 and a plunger spring end 166; and, plunger head switch activation arm 168, plunger middle switch activation arm 170, and plunger rear switch activation arm 172 (FIGS. 10 and 11). The plunger 18 is made from a glass-filled polyester which is softer than the housing's 12 CELEANESE N-276 material to provide ease of movement.

The plunger head 152 fits within the housing plunger head recess 42 which provides clearance for the plunger 18 to axially displace. The plunger head bearing 154 fits within the housing plunger head journal 44, and the plunger rear bearing 158 fits within the housing plunger rear journal 46 to provide for low friction, stabilized axial displacement. The plunger body 156 contains the plunger spring end 166, and the plunger spring stationary end 164 fits within the housing base spring recess 48. The installed plunger spring 162 provides a 4.5 to 7.5 pound (20.02 to 33.35 Newton) load biasing force.

Figure 2:
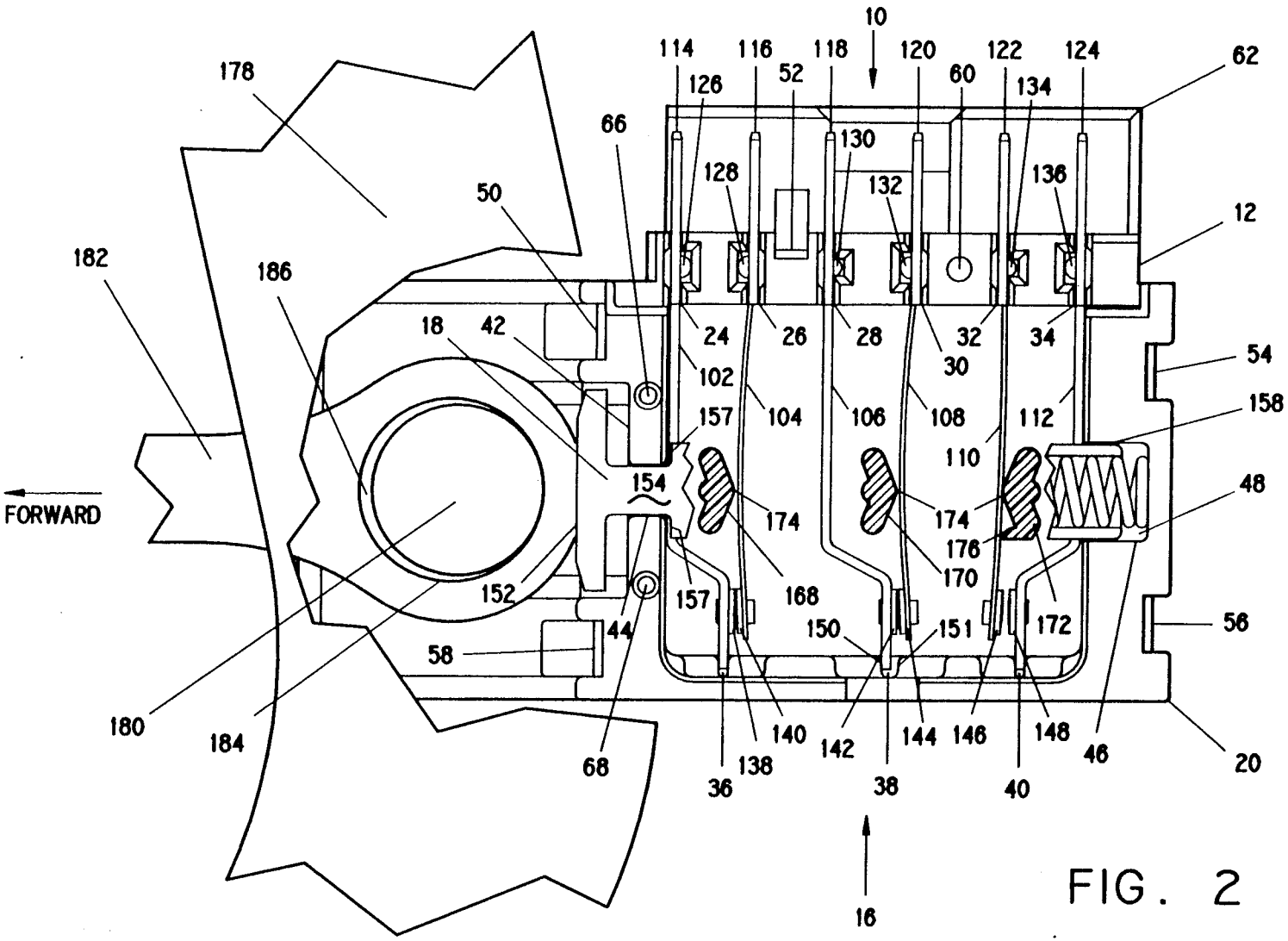
FIG. 2 is another view of the invention in the spring biased position.

Referring to FIG. 2, plunger head switch activation arm 168, middle switch activation arm 170, and rear switch activation arm 172 move spring blades 104, 108, and 110 respectively when the plunger 18 is axially displaced. Plunger head switch activation arm 168, middle switch activation arm 170, and rear switch activation arm 172 have a convex surface 174 that contacts spring blades 104, 108, and 110 respectively. The convex surface 174 provides for ease of manufacturing molded parts, a bearing surface for slippage when spring blades 104, 108, and 110 are displaced, and allows spring blades 104 and 108 to flex when pressure is applied by the plunger head switch activation arm 168 and middle switch activation arm 170 to decrease stress on spring blades 104 and 108. Plunger rear switch activation arm 172 has a tab 176 to increase the effective force that rear switch activation arm 172 can provide to spring blade 110 to break contacts 146 and 148 when the plunger 18 returns to its biased position. The plunger spring 162 provides a force of 4.5 to 7.5 pounds (20.02 to 33.35 Newtons) that is applied to spring blade 110 to break any contact weld that has formed between contacts 146 and 148 when the operator releases pressure from the brake pedal.

Plunger head switch activation arm 168 and middle switch activation arm 170 are biased closed positioned to apply pressure to spring blades 104 and 108 respectively when the plunger 18 is depressed to break electrical contacts 138 and 140 and electrical contacts 142 and 144 respectively. Plunger 18 rear switch activation arm 172 is biased open positioned to release pressure from spring blade 110 when the plunger 18 is depressed to make electrical contacts 146 and 148.

It is a feature of this invention that plunger head switch activation arm 168, middle switch activation arm 170, and rear switch activation arm 172 can be individually positioned when manufactured to either make or break spring blade 104, 108, and 110 electrical contact when the plunger 18 is depressed. Additionally when manufactured, plunger head switch activation arm 168, middle switch activation arm 170, and rear switch activation arm 172 can be positioned to provide switch sequencing and can be micro-adjusted to compensate for manufacturing component variations. Compensation adjustments to the plunger head switch activation arm 168, middle switch activation arm 170, and rear switch activation arm 172 reduce production costs because the only one part can be adjusted to bring many other components into tolerance.

Operation of the device is now described. Referring to FIG. 1, the self-adjusting multicircuit brake switch 10 is shown installed on an automobile brake pedal 178. The self-adjusting multicircuit brake switch 10 can either be mounted on an brake pedal 178 installed in an automobile or on a separate brake pedal assembly which is then installed in the automobile.

In either case, mounting the assembled self-adjusting multicircuit brake switch 10 is accomplished by first positioning the housing cover 22 mounting slot 98 over the master cylinder push rod 182 and the brake pedal push pin 180, so the master cylinder push rod is sandwiched between the mounting means 14 of the housing cover 22 and the housing base 20. Next, the self-adjusting automotive brake switch 10 is moved toward the brake pedal 178, so the brake pedal pin 180 passes through the housing base bushing 100. Finally, the self-adjusting multicircuit automotive brake switch 10, with the master cylinder push rod 182 sandwiched in between the mounting means 14 of the housing cover mounting slot 98 and the housing base bushing 100, is positioned on the brake pedal pin 180 and a locking clip or other locking device is attached to the end of the brake pedal push pin 180 to secure the self-adjusting multicircuit brake switch 10 in place.

Referring to FIGS. 1 and 2, in the spring biased position, the plunger 18 is extended. The extension is limited by the plunger's extension stop 157 which contacts the housing 20. The extended plunger 18 serves to bias the brake pedal pin 180 to the rearward side of the master cylinder push rod brake pedal mounting hole 184. Since the master cylinder push rod brake pedal mounting hole 184 is sized larger than the brake pedal push pin's 180 diameter a biased clearance 186 of approximately 0.050 inch (1.27 millimeters) is created.

In the spring biased position, the plunger head switch activation arm 168 does not apply pressure to spring blade 104, so electrical contacts 138 and 140 are closed creating an electrical circuit. The plunger middle switch activation arm 170 also does not apply pressure to spring blade 108, so electrical contacts 142 and 144 are closed creating an electrical circuit. Since the full spring force of spring blade 108 is being applied to stationary blade 106, stationary blade 106 is held in its depressed, unbiased position 150.

Finally, in the spring biased position, the plunger rear switch activation arm 172 applies pressure to spring blade 110, so electrical contacts 146 and 148 are held open, preventing an electrical circuit. It is a feature of this invention that plunger middle switch activation arm 170 can be configured like the plunger rear switch activation arm 172 to hold electrical contacts open when the plunger 18 is in its spring biased position.

Figure 3:
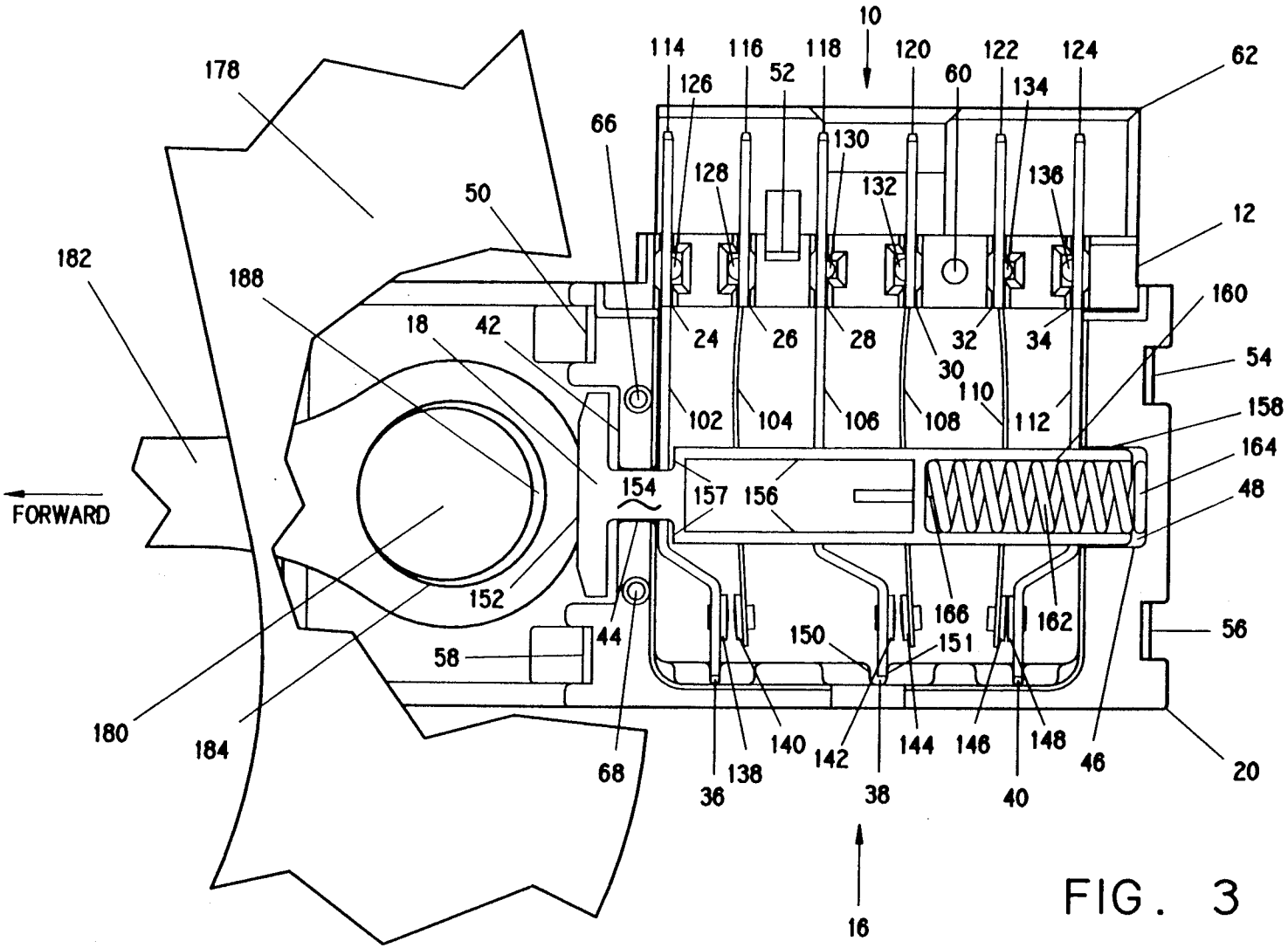
FIG. 3 is a view of the invention in a depressed position.
Figure 4:
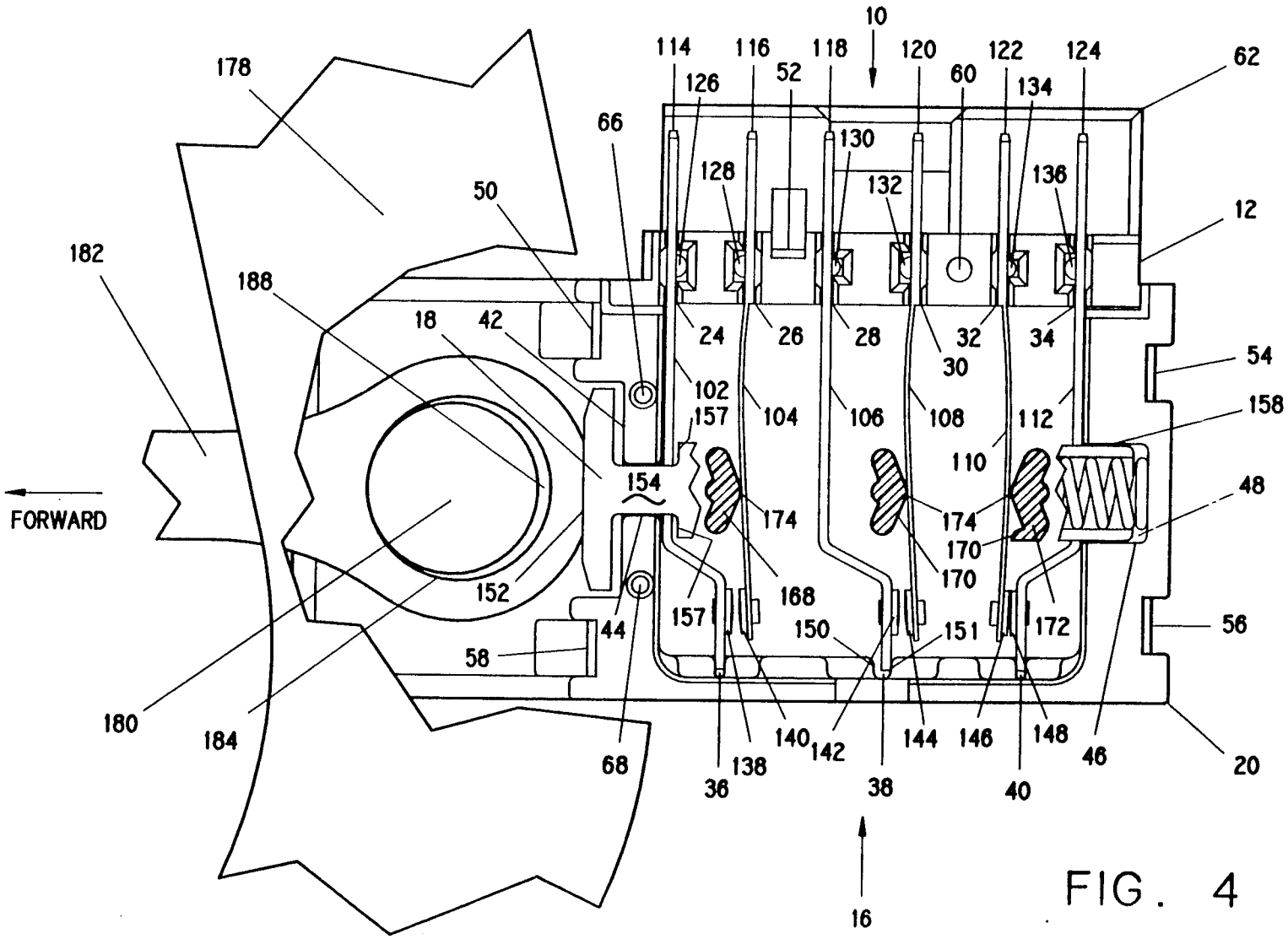
FIG. 4 is another view of the invention in the depressed position.

Referring to FIGS. 3 and 4, the multicircuit self-adjusting automotive brake switch is shown in the depressed position. When an automobile operator presses the brake pedal 178, the brake pedal push pin 180 moves forward. During the initial movement of the brake pedal push pin 180, the biased clearance 186 must be taken up before the brake pedal push pin 180 contacts the master cylinder push rod 182. It is during the taking up of this biased clearance 186 that the plunger 18 is depressed.

The biased clearance 186 is slightly less than the distance the plunger 18 is designed to displace. Since the brake pedal push pin 180 contacts master cylinder push rod 182 prior to completely depressing the plunger 18, once the biased clearance 186 is taken up, the actual braking force is applied to the master cylinder push rod 182 and not the plunger 18.

In the depressed position, the plunger head switch activation arm 168 applies pressure to spring blade 104, to open electrical contacts 138 and 140, opening an electrical circuit. The plunger middle switch activation arm 170 also applies pressure to spring blade 108, to open electrical contacts 144 and 142, opening an electrical circuit. Additionally with electrical contacts 144 and 142 open, spring blade 108 is no longer applying pressure to the stationary blade 106.

This release of pressure causes stationary blade 106 to move to its spring biased position 151. The movement of stationary blade 106 occurs as the plunger middle switch activation arm 170 applies pressure to spring blade 108. The movement of stationary blade 106 while spring blade 108 is being displaced causes a wiping or scrubbing action between electrical contacts 142 and 144. Finally, in the depressed position, the plunger base switch activation arm 172 releases pressure from spring blade 110, so electrical contacts 146 and 148 close, creating an electrical circuit.

We claim:

1. An automotive brake pedal actuated switch assembly comprising:

(a) a housing, (b) mounting means integral to said housing for mounting said housing on a pedal, (c) a plurality of switches enclosed in said housing, and (d) a spring biased plunger with integral switch activation arms selectively engaging said plurality of switches actuated prior to movement of a master cylinder push rod connected to the pedal.

2. An automotive brake pedal actuated switch assembly according to claim 1 wherein said plurality of switches includes a switch with a stationary blade, a spring blade, and electrical contacts.

3. An automotive brake pedal actuated switch assembly according to claim 2 wherein said stationary blade includes an integral terminal.

4. An automotive brake pedal actuated switch assembly according to claim 2 wherein said spring blade includes an integral terminal.

5. An automotive brake pedal actuated switch assembly according to claim 4 wherein said spring blade integral terminal is folded so said spring blade integral terminal is thicker and more rigid than said spring blade.

6. An automotive brake pedal actuated switch assembly according to claim 2 wherein said spring blade is biased closing said electrical contacts.

7. An automotive brake pedal actuated switch assembly according to claim 2 wherein said spring blade and said stationary blade include an alignment nub.

8. An automotive brake pedal actuated switch assembly according to claim 2 wherein a stationary blade mount is wider than said stationary blade creating a clearance, and said stationary blade is biased toward a clearance edge.

9. An automotive brake pedal actuated switch assembly according to claim 8 wherein an electrical contact wiping action is created when a spring blade makes contact or breaks contact with said stationary blade biased toward said clearance edge causing stationary blade movement.

10. An automotive brake pedal actuated switch assembly according to claim 2 wherein said electrical contacts include:

(a) a silver plated copper contact, and (b) a silver-copper-nickel alloy contact.

11. An automotive brake pedal actuated switch assembly according to claim 1 wherein said spring biased plunger with integral switch activation arms includes:

(a) a biased position and a depressed position, (b) a biased closed switch activation arm positioned, so when said spring biased plunger is in said biased position said biased closed switch activation arm does not apply pressure to a spring blade to make electrical contact with a stationary blade, and when said spring biased plunger is in said depressed position said biased closed switch activation arm applies pressure to said spring blade to break electrical contact with said stationary blade.

12. An automotive brake pedal actuated switch assembly according to claim 1 wherein said spring biased plunger with integral switch activation arms includes:

(a) a biased position and a depressed position, (b) a biased open switch activation arm positioned so when said spring biased plunger is in said biased position said biased open switch activation arm applies pressure to a spring blade to break electrical contact with a stationary blade and when said spring biased plunger is in said depressed position said biased open switch activation arm releases pressure on said spring blade to make electrical contact with said stationary blade.

13. An automotive brake pedal actuated switch assembly according to claim 1 wherein said spring biased plunger with integral switch activation arms includes activation arms positioned to selectively engaged said plurality of switches to produce switch sequencing.

14. An automotive brake pedal actuated switch assembly according to claim 1 wherein said spring biased plunger with integral switch activation arms includes an activation arm that is micro-adjusted during production to compensate for production tolerance variances from other parts of said automotive brake pedal actuated switch assembly.

15. An automotive brake pedal actuated switch assembly according to claim 1 wherein said spring biased plunger with integral switch activation arms includes:

(a) a switch activation arm with a convex surface for actuating a spring blade, and (b) a switch activation arm with a tab for actuating said spring blade.

16. An automotive brake pedal actuated switch assembly according to claim 1 wherein said housing forms an integral female terminal socket.

17. An automotive brake pedal actuated switch assembly according to claim 1 wherein said housing includes a housing cover with a smooth exterior.

18. An automotive brake pedal actuated switch assembly according to claim 1 wherein said plurality of switches are actuated between a terminal and a contact.

19. An automotive brake pedal actuated switch assembly acording to claim 1 wherein said spring biased plunger is a one-piece integral plunger.

20. In an automotive brake pedal actuated switch assembly a method of operating a plurality of blade switches upon pressure applied to an automotive brake pedal, comprising the steps of:

(a) providing a spring biased plunger with integral switch activation arms selectively engaging a plurality of blade switches enclosed in a housing;

(b) providing a brake pedal push pin and a master cylinder push rod with a mounting opening having a larger diameter than the diameter of said brake pedal push pin so when said master cylinder push rod is fitted over said brake pedal push pin a clearance is created;

(c) mounting said housing on said brake pedal push pin, so a master cylinder push rod mounting opening engages said brake pedal push pin;

(d) self-adjusting said brake switch by said spring biased plunger urging said master cylinder push rod against said brake pedal push pin thereby offsetting said clearance and compensating for brake pedal tolerances and master cylinder tolerances;

(e) depressing said brake pedal and thereby actuating said spring biased plunger when said brake pedal moves through said clearance prior to movement of a master cylinder push rod; and, (f) operating said plurality of blade switches when said plunger actuates by plunger integral switch activation arms selectively engaging said plurality of blade switches.

* * * * *